US006719937B1

(12) United States Patent
Kratzke et al.

(10) Patent No.: US 6,719,937 B1
(45) Date of Patent: Apr. 13, 2004

(54) METHOD FOR MAKING POLYAMIDE FIBERS

(75) Inventors: Hartmut Kratzke, Rendswuhren (DE); Jürgen Lasch, Neumunster (DE)

(73) Assignee: Rhodia Performance Fibres, Saint-Laurent Blangy (FR)

( * ) Notice: Subject to any disclaimer, the term of this patent is extended or adjusted under 35 U.S.C. 154(b) by 0 days.

(21) Appl. No.: 09/743,384

(22) PCT Filed: Jul. 6, 1999

(86) PCT No.: PCT/FR99/01629

§ 371 (c)(1),
(2), (4) Date: Mar. 14, 2001

(87) PCT Pub. No.: WO00/03076

PCT Pub. Date: Jan. 20, 2000

(30) Foreign Application Priority Data

Jul. 10, 1998 (FR) ..... 98 09071

(51) Int. Cl.[7] ..... D01D 5/16; D01F 1/10; D01F 6/60

(52) U.S. Cl. ..... 264/210.6; 264/210.8; 264/211; 264/211.22

(58) Field of Search ..... 264/210.6, 210.8, 264/211, 211.22

(56) References Cited

U.S. PATENT DOCUMENTS 5,236,652 A * 8/1993 Kidder ..... 264/211

FOREIGN PATENT DOCUMENTS

EP 0639664 A1 * 2/1995
EP 0839862 A1 * 5/1998

* cited by examiner

*Primary Examiner*—Leo B. Tentoni

(57) ABSTRACT

The invention relates to a process for manufacturing polyamide fibers having properties suitable and compatible for use as fibers for the manufacture of felt for paper machines. The process of the invention relates more particularly to the addition of stabilizers to the polyamide in order to obtain polyamide fibers having high properties, especially high resistance to light, heat and aggressive environments. The process of the invention consists in adding the stabilizer directly to the polyamide, without producing a preblend, and then in mixing the polyamide with the additive in an extruder for feeding the composition into a die for obtaining filaments.

8 Claims, No Drawings

METHOD FOR MAKING POLYAMIDE FIBERS

This application is an application under 35 U.S.C. Section 371 of International Application Number PCT/FR99/01629 filed on Jul. 6, 1999.

The invention relates to a process for manufacturing polyamide fibers having properties suitable and compatible for use as fibers for the manufacture of felt for paper machines.

The process of the invention relates more particularly to the addition of stabilizers to the polyamide in order to obtain polyamide fibers having high properties, especially high resistance to light, heat and aggressive environments.

BACKGROUND OF THE INVENTION

Heat, light and UV stabilizers are often added to polymers and more particularly to polyamides in order to reduce the degradation caused by heat or chemical attack.

When polyamide fibers are used in felts for paper machines, a high degree of stabilization is required since these felts are used in a particularly aggressive environment.

Thus, these felts are exposed to highly basic or acidic oxidizing media which seriously reduce the lifetime of the felt.

Several methods of adding stabilizers to polymers are already known.

For example, the stabilizers may be introduced directly in an autoclave during the polymerization steps. However, this method of addition has certain drawbacks. In fact, it is very difficult to add large amounts of stabilizers since a foaming phenomenon occurs in the autoclave when adding stabilizers in solution form.

Consequently, this method does not make it possible to achieve a degree of stabilization of the polyamide sufficient for the felt application for paper machines.

Patent EP 0 683 828 describes another method of adding consisting in the use of a polyamide composition concentrated in terms of stabilizers, also called in the formulation field a "masterbatch". This concentrated composition is mixed with the polyamide. Using this method, it is possible to add from 0.05% to 5% by weight of stabilizers to the polyamide.

However, the use of concentrated compositions or masterbatches also has drawbacks since the polymer used for the manufacture of the masterbatch is generally different from the polyamide forming the fibers. Thus, this polymer often has a melting point lower than the polyamide. This point is illustrated by Example 1 of Patent EP 0 683 828 in which the concentrated composition is obtained from a copolyamide sold under the brand name ELVAMIDE by E. I. DuPont de Nemours, the polyamide forming the fiber being nylon-6,6.

This addition of a polymer different from that used for manufacturing the fiber may modify the properties of the latter.

Furthermore, the polymer used for producing the concentrated composition undergoes two successive melting steps which are also detrimental to the final properties of the fiber as they increase the degradation of the polymer and the concentration of degradation products in the fiber. Finally, this additional step of manufacturing a concentrated composition increases the manufacturing cost of the fiber.

Patent EP 0 287 297 describes another method of adding stabilizers to polyamide granules. This method consists in forming a coating on the granules with the stabilizer and then in introducing these coated granules into an extrusion process.

This process also requires an additional step of mixing the additives into the polyamide, which step consists in producing the coating in a rotating bowl or pelletizer. This additional step also increases the manufacturing cost of the fibers.

One of the objectives of the present invention is especially to remedy these drawbacks by providing a process requiring no additional step for producing the additive/polyamide mixture and by limiting the degradation of the polyamide.

BRIEF SUMMARY OF THE INVENTION

For this purpose, the invention provides a process for manufacturing polyamide fibers comprising the following steps:

- feeding a polyamide into an extruder;
- adding to the polyamide at least one stabilizer either directly into the polyamide in the solid state, before it is fed into the extruder, or directly into the extruder;
- melting the polyamide and mixing the latter with the stabilizer in the extruder;
- extruding the molten polyamide composition through a die in order to form filaments having a titer after drawing of between 1 and 70 dtex.

DETAILED DESCRIPTION OF THE INVENTION

According to one Characteristic of the invention, the weight concentration of stabilizers in the final composition, or in the fibers, is between 0.05% and 5% by weight with respect to the weight of polyamide.

According to a preferred characteristic of the invention, the extruder is a twin-screw extruder which makes it possible to achieve a high degree of mixing of the additives into the polyamide.

However, a single-screw extruder can also be used to carry out the process of the invention, but this extruder must have a screw with a profile suitable for obtaining effective mixing of the additives into the polyamide.

According to the invention, the stabilizers are chosen from the class of light UV and heat stabilizers.

The stabilizers suitable for the invention are, for example, stabilizers chosen from the group comprising phenols substituted with alkyl and/or aryl groups, phosphites substituted with alkyl and/or aryl groups, phosphonates substituted with alkyl and/or aryl groups and mixtures of these.

Preferably, the stabilizers may be 1,3,5-trimethyl-2,4,6-tris (3,5-tetrabutyl-4-hydroxybenzyl) benzene sold by Ciba-Geigy under the brand name IRGANOX 1330, N,N-hexamethylenebis(3,5-di-tert-butyl-4-hydrxyhydrocinnamamide) sold by Ciba-Geigy under the brand name IRGANOX 1098 and tris (2,4-di-tert-butylphenyl) phosphite sold by Ciba-Geigy under the brand name IRGAFOX 168. The stabilizer may also be a mixture of these various products.

By way of example, mention may be made of the stabilizer sold by Ciba-Geigy under the brand name IRGANOX B 1171 which is a mixture containing 50% by weight IRGAFOX 168 and 50% by weight IRGANOX 1098.

According to a preferred characteristic of the invention, the stabilizer concentration in the fiber or in the final composition is advantageously between 0.05% and 2% by weight with respect to the weight of polyamide (the limits form part of the range).

According to another preferred characteristic of the invention, the viscosity of the polyamide forming the fibers or filaments is at least equal to that of the polyamide fed into the extruder.

In a preferred embodiment, the viscosity index of the extruded filaments is greater than that of the polyamide fed into the extruder and is equal to a value of between the viscosity index of the fed polyamide and 1.5 times this value, for example between 1.1 and 1.25 times this value. According to this embodiment, the additives are sufficiently well distributed in the polymer for the filaments to have a viscosity index uniformly increased without any loss of properties. The increase in the viscosity index of the filaments furthermore gives them greater abrasion resistance, a useful property especially for the manufacture of felts for paper machines.

The polyamides suitable for the invention are especially linear aliphatic homopolymer polyamides or copolyamides. Preferably, these polyamides are poly(hexamethylene adipamide), polycaproamide, copolymers thereof or blends thereof.

The process of the invention may also be carried out with other polyamides such as, for example, poly (aminoundecanoamide), poly (aminododecanoamide), poly (hexamethylene sebacamide), poly (p-xylylene azeleamide), poly (m-xylylene adipamide) and polyamides obtained from bis (p-aminocyclohexyl) methane and azelaic acid, sebacic acid or homologous aliphatic acids. The copolymers of these polyamides and blends thereof may also be used.

The polyamide compositions may also contain additives other than the abovementioned stabilizers.

These other additives may be added to the polyamide in various ways such as, for example, during the polymerization step, or to the polyamide in concentrated composition form, also called "masterbatch".

However, in a preferred embodiment the other additives are added to the polyamide using a method similar to that used for adding the stabilizers.

According to another preferred characteristic of the invention, the polyamide suitable for carrying out the process has a viscosity index of between 135 ml/g and 260 ml/g.

This viscosity index is determined from a solution in formic acid of 90% concentration and at a temperature of 25° C.

Further details and advantages of the invention will become more clearly apparent in the light of the examples given below, solely by way of indication.

EXAMPLES 1 to 3

Granules of a poly (caproamide) (PA-6) having a viscosity index of 145 ml/g before extrusion and a powder of a stabilizer described above and sold under the name IRGANOX B 1171 are fed continuously in the form of two separate streams into a feed chute of a twin-screw extruder having the following characteristics.

The extruder is a machine sold under the name LEISTRITZ and has two corotating screws, each screw having a diameter of 34 mm and a length of 1200 mm.

The speed of rotation is 150 revolutions/minute.

The residence time of the polymer in the screws is 4 minutes.

The extruder comprises 11 independent temperature-controlled zones.

In the first zones, the polyamide is melted at a temperature of 245° C. The mixing of the polyamide with the additives is carried out in the following zones. Finally, in the final zones, the molten composition is compressed before being fed into a die. The temperature of the polyamide at the die exit is between 243° C. and 250° C., depending on the examples.

After the composition has melted in the extruder, it is pushed through a die comprising die holes 0.3 mm in diameter and 0.6 mm in length.

The filaments obtained at an extrusion rate of 300 m/min. are drawn over rolls with a draw ratio of 3.5. The final titer of the filaments is 70 dtex.

The properties of the fibers are measured by determining the viscosity index on the fibers.

| Example | 1<br>no additive | 2<br>0.3 wt %<br>IRGANOX<br>B 1171 | 3<br>0.6 wt %<br>IRGANOX<br>B 1171 |
|---|---|---|---|
| IV (mg/l) Before extrusion | 145 | 145 | 145 |
| IV (mg/l) After extrusion | 150 | 170 | 178 |

EXAMPLES 4 to 6

Further examples were produced by replacing the PA-6 with a nylon-6,6 having a viscosity index of 140 ml/g.

The other characteristics and conditions are identical to those of Examples 1 to 3.

The results are given in the following table.

| Example | 4<br>no additive | 5<br>0.3 wt %<br>IRGANOX<br>B 1171 | 6<br>0.6 wt %<br>IRGANOX<br>B 1171 |
|---|---|---|---|
| IV (mg/l) Before extrusion | 140 | 140 | 140 |
| IV (mg/l) After extrusion | 145 | 155 | 172 |

The filaments according to the invention have a viscosity index greater than that of the polymer introduced before extrusion. The use of the additives causes no difficulties in extrusion.

What is claimed is:

1. A process for manufacturing polyamide fibers, comprising the steps of:

a) feeding a solid polyamide into an extruder;

b) adding only a stabilizer powder to said polyamide either directly into the solid polyamide, before it is fed into the extruder, or into the extruder;

c) melting and mixing the polyamide and the stabilizer powder in the extruder to form a molten composition; and d) extruding the molten composition through a die in order to form filaments having a titer after drawing of between 1 and 70 dtex.

2. The process according to claim 1, wherein the stabilizer is a heat, light or UV stabilizer.

3. The process according to claim 2, wherein the stabilizer is a phenol substituted with alkyl or aryl groups, a phosphite substituted with alkyl or aryl groups, or a phosphonate substituted with alkyl or aryl groups.

4. The process according to claim 1, wherein the stabilizer has a weight concentration in the fiber of between 0.05% and 5% with respect to the weight of polyamide.

5. The process according to claim 4, wherein the weight concentration is between 0.05% and 2%.

6. The process according to claim 1, wherein the extruder is a twin-screw extruder.

7. The process according to claim 1, wherein the polyamide is a nylon-6, a nylon-6,6, or a copolymer thereof.

8. The process according to claim 1, wherein the stabilizer is 1,3,5-trimethyl-2,4,6-tris (3,5-tert-butyl-4-hydroxybenzyl) benzene, N,N-hexamethylenebis(3,5-di-tert-butyl-4-hydroxyhydro-cinnamamide), or tris(2,4-di-tert-butylphenyl) phosphite.

* * * * *